United States Patent [19]

Lam et al.

[11] Patent Number: 4,606,097

[45] Date of Patent: Aug. 19, 1986

[54] SNAP-FIT-BUTTON

[76] Inventors: Kam Yau Lam; Kam Kheong Lam; Kam Hoong Lam, all of C-17 Kuan Woh Yuen, Ipoh, Perak, Malaysia

[21] Appl. No.: 746,357

[22] Filed: Jun. 19, 1985

[30] Foreign Application Priority Data

Jun. 20, 1984 [GB] United Kingdom ..... 8415713

[51] Int. Cl.[4] ..... A44B 1/38

[52] U.S. Cl. ..... 24/108; 24/90 R; 24/90 E; 24/102 R

[58] Field of Search ..... 24/108, 102 R, 102 A, 24/103, 90 R, 90 A, 90 E, 90.5

[56] References Cited

U.S. PATENT DOCUMENTS

| | | | |
|---|---|---|---|
| 274,607 | 3/1883 | Humphreys | 24/108 |
| 553,210 | 1/1896 | Mead | 24/90 R |
| 590,506 | 9/1897 | Watson | 24/90.5 |
| 1,183,422 | 5/1916 | Anderson | 24/108 |
| 1,277,060 | 8/1918 | Gorton | 24/90 E |
| 2,118,561 | 5/1938 | Kleeberg | 24/90 E |
| 3,360,835 | 1/1968 | Foertmeyer | 24/90 R |
| 3,725,980 | 4/1973 | Burgio | 24/90 A |
| 4,457,050 | 7/1984 | Kanzaka | 24/108 |

*Primary Examiner*—Victor N. Sakran
*Attorney, Agent, or Firm*—Ladas & Parry

[57] ABSTRACT

A button has a body and a retainer for securing the body to cloth. The retainer has a T-shaped member with the leg of the T-shaped member remote from the cross piece shaped to form a hollow cup-shaped resiliently expandable member, the rim of which is directed toward the cross piece. The body has a receptacle formed by a blind bore opening into a cup-shaped cross section similar to that of the resiliently expandable member. In operation the resiliently expandable member rim is contracted and the resiliently expandable member is pushed through the bore into the receptacle cup-shaped cross section whereupon the resiliently expandable member expands to hold the retainer in locked position with the body.

5 Claims, 4 Drawing Figures

1/1

SNAP-FIT-BUTTON

This invention relates to a button and, in particular, to a button which may be secured to a material without the necessity of using thread.

A known button which may be secured without the use of thread comprises a disc-shaped body with an axial hollow stem extending from the body and a disc-shaped retainer having an axially and perpendicularly disposed corrugated column which is arranged to frictionally engage within the stem. Such a known button requires a considerable amount of force to press the body and retainer together and the frictional engagement by the corrugations is not entirely satisfactory.

The present invention seeks to provide an improved button in which the foregoing disadvantages are substantially mitigated.

According to this invention there is provided a button comprising a body and a retainer for securing the body to a material, the retainer having a T cross-sectionally shaped member with the leg of the T cross-sectionally shaped member remote from a cross piece of said T cross-sectionally shaped member connected to the inside base of a hollow cup-shaped resiliently expandable member, a rim of the resiliently expandable member being directed toward said cross piece and surrounding the said leg, said tcdy being provided with a receptacle having a similar cup-shaped cross-section to receive the resiliently expandable member and lip means about the receptacle for engaging over the rim of the resiliently expandable member whereby to insert the resiliently expandable member into the receptacle the rim of the resiliently expandable member is contracted and the resiliently expandable member subsequently expands inside the receptacle to be secured therein with the outer surfaces of the resiliently expandable member at least in partial with the inside surfaces of the receptacle.

Preferably the body has one flat face and the receptacle is formed by a blind bore extending from said flat face, the blind end of which is enlarged to form said complementary cup-shaped cross-section.

Advantageously, the rim of the resiliently expandable member is provided with a plurality of V-shaped apertures to enable the resiliently expandable member to contract upon insertion into the blind bore.

Advantageously the T cross-sectionally shaped member is integrally formed with the resiliently expandable member.

The cup-shaped resiliently expandable member may be complementarily shaped with the cup shape of the receptacle.

The invention will now be described, by way of example, with reference to the accompanying drawings in which.

Figure 4:
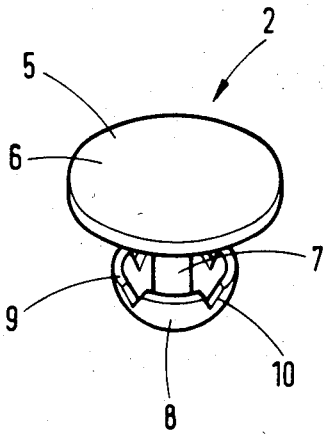

FIG. 4 a detail of a retainer used in the invention.

In the figures like reference numerals denote like parts.

Figure 1:
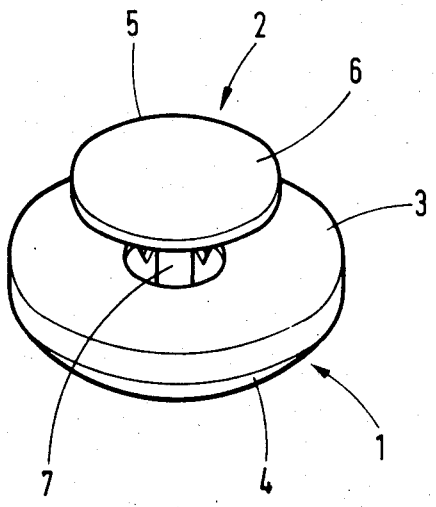
FIG. 1 shows a perspective view of a button in accordance with this invention.

The button shown in FIG. 1 has a body 1 for accepting a retainer 2. The body has a flat face 3 for abutting against one side of the material (not shown) and the outer side 4 of the body is arcuate, the body having a circular cross-section. The retainer 2 is formed by a T cross-sectionally shaped member 5 with the cross piece 6 of the T having a circular cross-section and with the leg 7 of the T also having a circular cross-section. The underside of the cross piece 6 is arranged, in use, to abut the side of the material to which the button is to be fastened remote from face 3 and the T-shaped member 5 is integrally formed with a resiliently expandable member 8.

Figure 2:
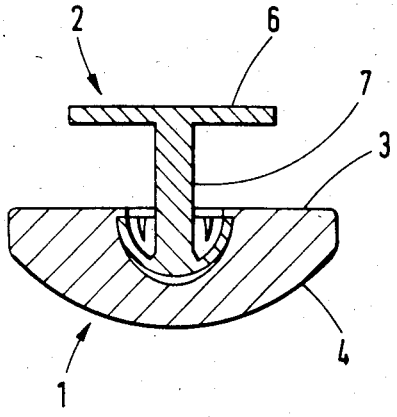
FIG. 2 shows a vertical cross-section through the button of FIG. 1.
Figure 3:
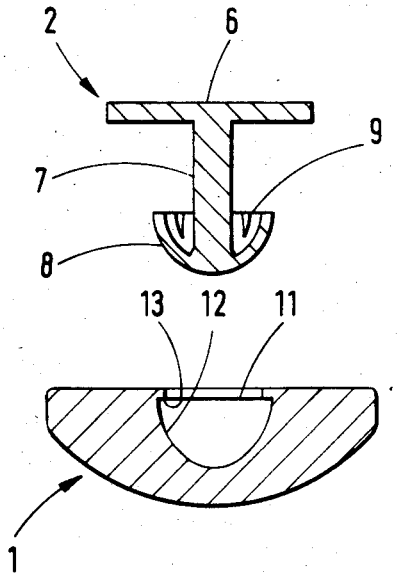
FIG. 3 shows an expanded view of the members shown in FIG. 2.

As best shown in FIGS. 2, 3 and 4 the end of the leg 7 remote from the cross piece 6 is moulded to the internal base of a resiliently expandable approximately hemispherical hollow cup-shaped member 8 having a rim 9 directed toward the cross piece 6 and circumferentially surrounding the leg 7. A series of V-shaped apertures 10 are provided in the rim to permit the rim 9 to radially contract from its normally expanded position shown in FIG. 4.

Referring now, in particular, to FIGS. 2 and 3, the body 1 is formed by a blind bore 11 extending from the flat face 3 and the blind end of the bore 11 is enlarged to form a cup-shape which is slightly larger than but similar to with the cup-shape of the resiliently expandable menber 8. In this respect, the bore 11 forms part of a receptacle having a cavity 12 with a similar hemispherical cup-shape, which may be complementary, to that of the resiliently expandable member 8 and a circumferential lip 13 is formed at the confluence between the cavity 12 and bore 11.

In use, to secure the button to a material, a small hole is made in the material sufficient to permit the resiliently expandable member 8 to pass therethrough and so that one side of the material is brought into abutting relationship with the underside of the cross piece 6. The bore 11 is then brought into contact with the hemi-spherical outer surface of the cup-shaped resiliently expandable member 8 and upon pressing the retainer 2 toward the body 1 so the rim 9 of the member 8 is radially contracted thereby closing the apertures 10 until member 8 passes through the bore 11 and into the cavity 12 of the receptacle whereupon the rim 9 of the resiliently expandable member 8 expands so that the rim underlies the lip 13 of the receptacle.

The dimensions of the resiliently expandable member and of the receptacle are arranged so that the hemispherical shape of the receptacle will prevent the resiliently expandable member 8 from expanding and inverting so that the body and retainer are securely fastened in position. Furthermore, by arranging the receptacle and resiliently expandable member to have an approximately hemi-spherical shape so the members are securely fastened over a relatively large angular movement therebetween.

The button of this invention has been found not only easy to assemble but is able to withstand greater strain than the prior art buttons due to the cup-shaped member 8. The complementary shape of the cavity 12 also serves to prevent the member 8 from changing shape so that the member 8 is securely fastened.

It will be realised that the benefit and utility of the invention may also be achieved with other than hemispherical shapes, the essence being that a cup-shape is provided—which could, for example, be square in section—on the member 8 and a similar shape is provided in the body receptacle which may be substantially complementary with respect dimensions.

We claim:

1. A button comprising a body and a retainer for securing the body to a material; the retainer having a T cross-sectionally shaped member with the leg of the T cross-sectionally shaped member remote from a cross piece of said T cross-sectionally shaped member connected to the inside top end of a dished, cup-shaped resiliently expandable member, a rim of the resiliently expandable member remote from said top end being directed toward said cross piece and circumferentially surrounding but not contacting the said leg; said body being provided with a blind bore having an outer part of smaller cross section than the normal cross section of said resiliently expandable member, the blind end of said bore inwardly of said outer part opening into a receptacle having an approximately similar dished, cup-shape to said resiliently expandable member for receiving the resiliently expandable member therein; and lip means about the receptacle at the confluence of the bore for engaging over the rim of the resiliently expandable member, the rim of the resiliently expandable member being adapted to contract when pushed through said outer part of the bore and subsequently expandably returning to substantially normal cross section inside the receptacle to be secured therein with the outer surfaces of the resiliently expandable member at least in partial contact with the inside surfaces of the receptacle, the proximity of the contacting surfaces being such that the cup-shape of the resiliently expandable member cannot be turned inside out.

2. A button as claimed in claim 1 wherein the body has one flat face and the receptacle blind bore outer part extends from said flat face.

3. A button as claimed in claim 1 wherein the rim of the resiliently expandable member is provided with a plurality of V-shaped apertures to enable the resiliently expandable member to contract upon insertion into the blind bore.

4. A button as claimed in claim 1 wherein the T cross-sectionally shaped member is integrally formed with the resiliently expandable member.

5. A button as claimed in claim 1 wherein the cup-shaped resiliently expandable member is complementarily shaped with the cup shape of the receptacle.

* * * * *